United States Patent [19]

Lawson et al.

[11] Patent Number: 4,820,618

[45] Date of Patent: Apr. 11, 1989

[54] METHOD OF FORMING A COLOR PROOF BY COLOR ELECTROSTATOGRAPHY

[75] Inventors: Terence M. Lawson, Aldgate; Gregory A. Quilliam, Henley Beach, both of Australia

[73] Assignee: Stork Colorproofing B.V., Netherlands

[21] Appl. No.: 920,510

[22] Filed: Oct. 17, 1986

[30] Foreign Application Priority Data

Oct. 24, 1985 [AU] Australia ..... PH03075

[51] Int. Cl.[4] ..... G03G 13/20; G03G 13/22

[52] U.S. Cl. ..... 430/45; 430/42; 430/47; 430/97; 430/104; 430/124

[58] Field of Search ..... 430/42, 45, 47, 97, 430/104, 124

[56] References Cited

U.S. PATENT DOCUMENTS 3,704,119 11/1972 Honjo et al. ..... 430/33
3,820,987 6/1974 Wells et al. ..... 430/36 X
4,101,320 7/1978 Sellers et al. ..... 430/40
4,292,394 9/1981 Chu et al. ..... 430/291
4,429,027 1/1984 Chambers et al. ..... 430/39 X
4,510,223 4/1985 Kuehnle et al. ..... 430/47 X

*Primary Examiner*—Roland E. Martin
*Attorney, Agent, or Firm*—Silverman, Cass, Singer & Winburn, Ltd.

[57] ABSTRACT

An emulsified polymer color toner in a liquid carrier is provided for application to a latent electrostatic image on an electrostatographic recording member and transferred to a receptor sheet. The color toner consists of a colorant and a polymeric binder. A polymer solvent is applied to the receptor sheet surface carrying the deposited toner layer to dissolve part of the binder sufficient to transparentize the color layer, glaze and to fuse the toner layer. The glazing, transparentizing and fusing is effected without increase in dot gain. The polymer dispersant is insoluble in the toner carrier. The polymer solvent is removed from the receptor sheet and the sheet can be polished after removal of the solvent.

4 Claims, 1 Drawing Sheet

METHOD OF FORMING A COLOR PROOF BY COLOR ELECTROSTATOGRAPHY

BACKGROUND OF THE INVENTION

This invention relates to electrophotography and in particular relates to fusing, glazing and transparentizing of colored electrophotographic toner deposits contained on receiving member surfaces such as paper.

It is known to produce color prints by electrophotographic processes, such prints being commonly used as lithographic or gravure pre-press proofs, containing in general four colors, such as yellow, magenta, cyan and black. Such pre-press proofing processes are disclosed for instance in U.S. Pat. Nos. 3,337,340; 3,419,411; and 3,862,848.

It is customary to produce such electrophotographic pre-press proofs by charging a photoconductive recording member followed by exposure through a separation transparency corresponding to one color, followed by toning of the exposed photoconductor with a liquid dispersed toner of the appropriate color, followed by in-register transfer of the color toned image deposit to a receiving member surface, such as paper. These process steps are then repeated with separation transparencies of the other three or more colors and appropriate color toners to produce a multicolor print as required.

After all of the required color toner deposits have been transferred to the receiving member paper sheet, it is coated with a clear resin layer to transparentize the color toner deposits and fuse them to the paper sheet. Such coating may be carried out by spraying, curtain, roller or dip coating and the like.

The primary purpose of pre-press proofs is to assess color balance and strength which can be expected from the final press run and accordingly to correct the separation transparencies before the printing plates are made therefrom. In many instances, it is also required to produce socalled customer proofs for approval of subject, composition and general appearance of the print prior to press run. Thus, it is essential that the pre-press proof should have the same appearance as the press print, that is to say in addition to matching the colors and dot gain of the press print, the pre-press proof should be on the same paper as the press print, the image gloss should be identical to that of the image produced on the press with printing inks and the paper surface in the image-free areas should remain unaffected.

Color image deposits formed on paper by the previously described electrophotographic process differ from color image deposits formed by printing inks in that the latter contains very much more binder material of the resinous or varnish type than the deposits formed by liquid toners in electrophotography; typically printing inks contain about 73% by weight of binder material, whereas prior art liquid toners contain only about 33% or less binder material by weight. Such relatively large quantity of varnish or resin in the printing ink deposit firstly fuses the image deposit to the paper and secondly transparentizes the color ink layers, which is necessary for the underlying colors to become visible and thereby to give the desired color combination effect.

Thus the previously referred to step of glazing the pre-press proof prepared by the electrophotographic process is essential firstly to fuse the image deposits to the paper and secondly to saturate the image deposits with resin to transparentize them to the extent where their appearance with regards color combination effect and gloss are the same as that of printing ink deposits.

Prior art glazing processes have three major disadvantages. Firstly, the application of a resin coating normally alters considerably the surface appearance of the paper sheet by imparting additional gloss thereto and/or even rendering transparent the paper itself particularly in those instances where it comprises publication type stock such as newsprint. Secondly, the resin layer increases the apparent optical density of color toner deposits, the extent of such increase being different for different colors, and also varying in accordance with the uniformity of the overcoated resin layer. Thirdly, as we have now found, the resin coating in print-free areas of the paper surface very considerably increases dot gain.

The term "dot gain" is well known in the graphic arts. For a complete description of this phenomenon, reference should be made for instance to the article "The Effect of the Spread-Function of Paper on Half-Tone Reproduction," by J. A. C. Yule et al., TAPPI/-July 1967, Vol. 50, No. 7. For better understanding of this invention a brief description of the dot gain phenomenon will now be given relative to offset printing employing half-tone imagery, as is well known in the art.

A given percentage dot area of the film transparency employed to produce a printing plate can be exactly reproduced on the printed sheet provided the settings of the press, blanket pressure, ink/water balance, etc. are correct. It is found however, that even in such instances where no microscopically measurable dot distortion or spread occurs on the press, the density of the printed dot area is higher than would be expected by calculating the percentage dot area on the basis of the solid ink density on the printed sheet, that is to say, the measured density of the printed dot area of a given percentage is always equal to the density of a higher percentage dot area calculated on the basis of solid ink density. Such apparent increase in percentage dot over a given percentage dot in a known area is called dot gain.

It has been found that the extent of such dot gain depends mainly on the optical properties of the paper. The dots produce a shadow in the paper, which, the deeper it is in the paper, the more diffused and blurred it becomes. The more incident light between the dots is permitted by the optical nature of the paper to penetrate into the paper and scatter sideways towards and under the dot shadows, and the greater the depth of light penetration and hence higher incidence of diffused and blurred shadows, the more of the incident light will be absorbed and consequently less of the incident light will re-emerge from the dot-free areas and be reflected therefrom. The thus caused absorption of incident light results in a higher than expected density measurement of a given percentage dot area. Highly scattering paper surfaces, where the incident light is immediately reflected off the surface, produce therefore less dot gain than papers having a relatively transparent surface to incident light, such as uncoated papers with exposed fibers or highly reflective or glossy papers.

The half-tone screen ruling also affects dot gain to some extent because the above described effect of dot shadows on the incident light is amplified as the number of dots per unit area increases: thus, finer screen rulings produce higher dot gain than coarser screen rulings.

In 50% dot area a dot gain of 12 to 15% caused by the above factors on coated good quality paper is the accepted standard in normal printing. Higher dot gain indicates poor printing conditions and is generally unacceptable because it causes distortion of half-tone balance in the print.

It will be thus realized that the above referred to prior art methods of glazing electrophotographic pre-press proofs resulting in changes to the surface appearance of the paper, density increase of color deposits depending on glaze uniformity and increase in dot gain introduce very significant differences between such pre-press proofs and the printed paper, which limits considerably the usefulness of such proofs for the purposes of transparency correction approval.

SUMMARY OF THE INVENTION

The invention provides a method of producing an electrostatographic color proof having substantially the same appearance as color prints printed by offset or gravure processes with regards to transparency and gloss of image areas relative to image-free areas, said method comprising the steps of: providing electroscopic marking particles of appropriate color consisting of colorant and a polymeric binder for same to form said color deposit on said electrostatographic recording member, applying a solvent to the surface of said receptor sheet after transfer of said deposits of all appropriate colors from said electrostatographic recording member onto the receptor sheet, said solvent capable of solvating said binder in said electroscopic marking particles forming said color deposit thereon thereby to transparentize and increase the gloss of said color deposit as well as to render same adherent to said receptor sheet surface without affecting the gloss thereof in the image-free areas; and removing said solvent from said receptor sheet.

DESCRIPTION OF THE PREFERRED EMBODIMENT

Figure 1:
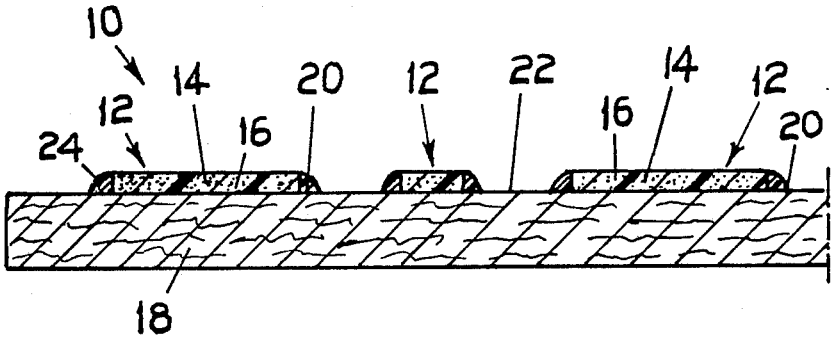
FIG. 1 is a diagrammatic sectional view taken through a color proof formed in accordance with the method of the invention.

Applicant has now found that the color toner deposits on electrophotographic pre-press proofs of the type referred to in the foregoing are exact reproductions of known percentage dots and before glazing or resin coating surprisingly do not show any increase in dot gain whatsoever. Applicant has transferred such color toner deposits onto a variety of printing stocks and in all cases before glazing, the dot gain has been found to be appropriate to the type of paper and to be acceptable in accordance with printing standards as described in the foregoing.

When the thus produced prints have been overall glazed or resin coated to various degrees of gloss and in all cases that dot gain has significantly increased and that such increase in dot gain is proportional, although not linearly, to increase in gloss level.

Subsequently, various types of printing paper have been glazed to progressively increasing gloss levels and color toner deposits transferred onto such glazed papers. Again, exact reproduction of known percentage dots were found, however, in this instance also found was surprisingly significant dot gain increase, substantially of the same extent as in the preceding experiment, that is, in proportion, although not linearly, to increase in gloss level. It should be noted that in this case no final glaze was applied to the prints.

From these experiments it can be concluded that electrophotographic pre-press type color toner deposits per se produce correct and acceptable dot gain, but show significant increase in dot gain upon overall glazing of the printing paper, irrespective whether such overall glazing is applied prior or after the transfer of such toner deposits onto the paper.

It has been stated in the foregoing that electrophotographic pre-press proofs must be glazed for image fusion and transparentization because prior art color toners for proof making contain very much less binder or resinous material in relation to pigment than conventional printing inks. The reason for this is that in color toners it is necessary to maintain the pigments in very finely dispersed state in order to produce correct hues without excessive greyness, but it is also necessary to produce high density images in many instances on photoconductors having relatively low surface voltages, which means that such color toners have to be made more sensitive electrophoretically than for instance copier type toners which produce high image densities generally by having weakly charged relatively large toner particles. While it is readily possible to incorporate into such large toner particles a high proportion of binder or resinous material for fixing purposes, prior art color toners for pre-press proofing contain only a small proportion of binder or resinous material, usually just sufficient to act as a dispersing agent, otherwise their electrophoretic sensitivity is significantly reduced.

Novel methods of preparing liquid color toners for pre-press proofing with novel materials and composition of matter have been found whereby the binder or resinous content in relation to the pigment can be increased to the correct level required for fixing and transparentizing the color image deposits without reducing the electrophoretic sensitivity of such toners. Pre-press proofs produced with toners of this invention do not require therefore overall glazing. Instead of glazing, the pre-press proof is exposed for a short time to a solvent for the binder or polymeric material contained within the color image deposits themselves whereby such polymeric material is temporarily dissolved or solvated or softened to a degree where it forms a substantially continuous phase or film within such color image deposits and effects thereby fixing and transparentization thereof upon evaporation of said solvent, that is upon drying. Thus pre-press proofs produced in this manner with the toners of this invention exhibit no increase in dot gain and the surface appearance of the paper is not affected in any way.

The toners of the present invention differ markedly from prior art color toners in that the means for glazing is combined with the depositing particle by way of a polymer particle which is insoluble in the selected carrier liquid for the toner and which co-deposits with the color or pigment containing particles. By the toner system of this invention very fine particles of the electrophoretic sensitivity required to deposit on low voltage photoconductors can be prepared and such toner deposits can be transferred to paper or other receptor materials with sufficient polymeric material to effect fixing to the substrate, to transparentize the deposits and to develop image gloss comparable to conventionally printed matter when such deposits are exposed to a solvent selected to dissolve or solvate the particular polymer employed.

The types of materials useful as polymers in accordance with this invention depend on the properties of the carrier liquid selected for the color toners, and more particularly they depend on the solvent power of the carrier liquid. As is well known in the art the range of isoparaffinic hydrocarbons called Isopars TM manufactured by the Exxon Corporation and similar materials which are safe in handling, have low toxicity, low aromatics content and high volume resistivity are suitable carrier liquids. Carrier liquids in this category are characterized by a quite low solvent power such as 26 to 28 KB, for which suitable polymers are for instance ketone formadehyde condensates, epoxy resins, polyester resins, vinyl resins, styrene resins, hydrocarbon resins and the like, such resins being selected to be insoluble in such carrier liquids, and generally to have melting points within the range of 50° to 150° C.

The preferred method of forming toner particles for use with this invention is firstly to disintegrate the selected polymer into particles of appropriate size by emulsifying the molten polymer, followed by cooling the emulsion to obtain discrete polymer particles. The coloring matter can be incorporated with the polymer particles before or during emulsification or can be admixed thereafter with the polymer particles.

Preparation of polymer emulsions is carried out by heating the polymer to a temperature above its melting point and introducing the molten polymer into a dispersant which also is heated to a temperature above the melting point of the polymer, such dispersant being selected to be a nonsolvent for the polymer. The mixture is charged into a high shear mixer such as a Waring blender or Ross Mixer or the like, together with a surfactant which is substantive to the polymer and the dispersant. The dispersant may be a high boiling point isoparaffinic hydrocarbon such as Isopar TM M by Exxon, or a paraffin oil or other similar high boiling point non-polar liquid. The surfactant, as previously stated, is selected to be substantive to the polymer and the dispersant, and may be for instance an alkylated polyvinyl pyrrolidone, or other preferably non-polar suspension and grinding aid conforming to the previously stated requirements.

The above described composition is mixed in the high shear mixer until the polymer particle size has been reduced to the required fineness, normally 2-5 microns, and the mixture is cooled to solidify the polymer particles and form a stable emulsion of such particles in the dispersant. Colorants, such as pigments or dyes, may be melt blended with the polymer prior to emulsification, or may be added during or after emulsion formation, as desired.

A further property of the surfactant is to be conducive to good pigment dispersion in the selected dispersant, in which case the pigment can be dispersed directly into the preformed polymer emulsion by techniques normally employed by ink, paint, and toner makers such as ball milling, sand grinding, attrition milling, roll milling, or the like. This soluble surfactant also should be substantive to the surface of the particular pigment or coloring matter used to effect particle comminution by wetting the surface of the pigment particles to form a fine dispersion thereof by dispersion techniques as listed above. It is also believed that such soluble surfactant forms a link between the emulsified polymer particles and the dispersed pigment or coloring matter, thereby creating the composite particle necessary for the formation of a homogeneous layer upon deposition by attraction to latent electrostatic image areas.

Materials which can be used to impart color to the polymer include both pigments and dyestuffs. Dyestuffs for this purpose may include basic dyes such as Rhodamine GG, Bismark brown R, both produced by Imperial Chemical Industries, Victoria blue FB, Auramine FA, both produced by BASF, azo dyes such as Neozapon black RE, produced by BASF, Oracet yellow GN and Orasol red 2B, both produced by Ciba-Geigy. Pigments may include carbon blacks, such as Vulcan XC-72, produced by Cabot Color Corporation, phthalocyanine blues, such as Irgalite blue GLSM, produced by Ciba-Geigy, azo yellows, such as Permanent yellows NCG, produced by Farbwerke Hoechst, and quinacridone reds, such as Quindro Magenta RV-6832, produced by Bayer.

The preferred colored polymer emulsion may be directly diluted with low KB solvent for use as an electrostatographic liquid toner, however, the addition of materials variously known to those skilled in the art of toner making as control agents, charge directors or image enhancers, may be desirable. Such materials comprise, for example, metallic salts of low KB solvent soluble acids such as cobalt, iron, manganese, copper and zirconium, salts of oleic, linoleic, naphthenic and octoic acids. Other such materials include soya bean lecithin, sodium deodecyl benzene sulphonate, neutral calcium sulphonate and alkylated mono and disuccinimides.

With regard to proportioning of the pigments or dyestuffs in or on the emulsified polymer, it has been found that with emulsions prepared in accordance with the present invention transparentization and solvent fixation can be achieved whilst maintaining purity of color at the correct hues with coloring matter to polymer ratios of between 1 to 0.5–3.0 with a preferred range of 1 to 0.7–1.2.

The proportion of final emulsified polymer in the carrier liquid has been found to be exceptionally wide. Polymer emulsions with contents of 1 to 80% by weight polymer have been prepared, and it has been found that the preferred range in the context of this invention is between 25 to 50% by weight of total emulsion including pigment or dye, polymer and surfactant.

The proportion of the surfactant is determined by its functional requirements, that is stabilization of the emulsion and wetting or dispersing the pigment or other coloring matter. Any excess over such functional quantity is not desirable as it may reduce the volume resistivity of the carrier liquid and the sensitivity of the toner, as well as render the toner self-fixing to greater or lesser extent, which can impair its transfer efficiency and cause filming on the photoconductor thereby affecting its reusability.

Depending on the concentration of the polymer in the emulsion, such emulsion can be used without further dilution as an electrostatographic liquid toner, or further diluted with suitable low KB solvent. In the context of the present invention where the preferred concentration of polymer in the emulsion is 25 to 50% by total weight, dilution to a working strength to levels of between 0.01 and 10% by weight can be made advantageously with a preferred concentration range of between 0.1 and 5% by weight. Such amounts vary depending on conditions such as the type of developing device employed, speed of development, nature of the photoconductor or latent image bearing substrate and type of image receiving member and such like factors well known in the art. Such dilution of the polymer emulsion with a suitable low KB solvent can be effected by simple addition of the required quantity with stirring to achieve homogenity. The nature of the emulsion prepared in accordance with the present invention is such that little additional energy is required to produce dilute concentrations of the finely dispersed polymer.

Liquids used for the fixation of the pre-press proof imagery, that is to say, of deposits formed with the toners of this invention on a photoconductive or dieletric recording member and transferred therefrom onto a receiving member such as printing stock paper, must be solvents or at least partial solvents for the polymer formed by emulsification technique previously described. Such liquids have been found to vary considerably in their nature depending upon the type of polymer deposited in the image areas. In the most preferred situation where the deposited polymer is of the epoxy type, a combination of aromatic and oxygenated hydrocarbons has been found to be most effective. The presence of a high boiling point oxygenated solvent such as Cellosolve acetate, butyl Cellosolve acetate, Carbitol acetate or butyl Carbitol acetate, all products of Union Carbide, has been found to be particularly advantageous in assisting the coalascence of pigment/polymer particles and migration of solvated polymer between overlayed color deposits and forming a continuous film or phase between color particles and thereby enhancing transparency and consequent visual interpretation of color combinations in that the thus fused or fixed image deposits very closely resemble press printed ink deposits with regards to structure and composition.

The liquids which can be used for the fixation of the image deposits formed from electrostatographic liquid toners prepared in accordance with the present invention may be applied to the image deposits by mechanical means such as spraying, immersion, doctor blade, curtain coating or by diffusion where the solvent is vaporized by heat and subsequently condensed on the image bearing member. The preferred method is by spraying where the solvent or solvent combination is applied to the image bearing member of atomization of the solvent in a suitable nozzle by means of air, or pressure, as produced in an airless spray equipment and projection of the atomized solvent particles to impinge on the image bearing member.

It has been found in some cases to be advantageous to apply heat to the solvent wetted image bearing member, especially when the solvent combination used contains a high boiling point solvent for the polymer. While not necessary to achieve fixation, heat has the advantage of facilitating coalescence of the dissolved polymer in the image areas as well as expediting the disposal of said solvent from the image and image bearing member.

In those instances in which image deposit gloss is inadequate after image fixation, which may be the case for instance where the pre-press proof is produced on inexpensive strongly absorbant and irregular surface newsprint or magazine publication type printing stock paper or where special high gloss printing effects are to be simulated, we have found that a burnishing or polishing treatment can be applied after evaporation of the fixing solvent to increase image gloss. Such polishing treatment does not cause any image deposit shift or distortion but appears to improve levelling of the top surface of the image deposit and in addition to remove bloom caused by solvent evaporation, thereby increasing image gloss. Such polishing can be carried out typically by means of a roller of the paint applicator type having its surface covered with a natural or synthetic long fiber material, cotton, velvet, fur, velour, felt or the like. Such roller may be pressed under relatively light pressure against the paper sheet carrying the image deposit, such paper sheet being supported preferably on a rotating cylindrical member. The polishing roller may be rotated or stationary as desired. If so desired burnishing or polishing can also be carried out by supporting the paper sheet on a flat member and having the rotating polishing roller traversing the paper surface under light pressure. Alternatively, polishing can be effected by passing the paper sheet through the nip of a set of rollers wherein one of such rollers acts as a guide or feed roll whereas the other roller facing the image bearing surface of the paper sheet acts as the polishing roller. In the simplest form polishing can be effected by lightly rubbing the image bearing surface of the paper sheet with a pad made of the above listed materials.

Referring to the drawing, the electrostatographic color proof resulting by practice of the methods disclosed herein is designated generally by reference character 10 and consists of image areas 12 formed by electroscopic marking particles 14. The particles 14 consist of a colorant 16 dispersed in a polymer binder, the binder being solvated by a solvent to fix the marking particle 14 to one surface 20 of the receptor member 18. The image free areas 22 remain unaffected with regard to appearance and gloss by the transfer and fixing steps in forming the image areas 12. The solution of the binder leaves a residue or polymer/continuum 24 which surrounds the colorant and fixes the particle to the surface of the receptor sheet 18.

There have been described novel methods for the production of electrostatographic color proofs and particularly of electrostatographic pre-press proofs on printing stock paper or other receptor member wherein the surface appearance of such paper is not affected in any way over its original state and wherein image gloss and dot gain are substantially the same as on press prints. The materials and their proportioning as disclosed herein are intended to be construed in illustrative sense only without restricting the scope of this invention.

What is claimed is:

1. The method of producing an electrostatographic color proof having substantially the same appearance as color prints printed by offset or gravure processes with regards to transparency and gloss of image areas relative to image-free areas, wherein said electrostatographic color proof comprises a receptor sheet containing on its surface image-free areas and image areas, said image areas consisting of color deposits in the form of at least one color layer, said method comprising the steps of:

forming an image of electroscopic marking particles of appropriate color consisting of colorant and a polymeric binder for same to form said color deposit on said electrostatographic recording member;

transferring said deposit of said appropriate color for a period of time sufficient to solvate from said electrostatographic recording member onto the receptor sheet, forming a continuum by applying a solvent to the surface of said receptor sheet, said binder in said electroscopic marking particles forming said color deposit thereon thereby to transparentize and increase the gloss of said color deposit without affecting the gloss of said receptor sheet in the image-free areas; and removing said solvent from said receptor sheet.

2. The method of producing an electrostatographic color proof according to claim 1, wherein said solvent dissolves.

3. The method of producing an electrostatographic color proof according to claim 1, wherein said solvent is sprayed on said receptor sheet.

4. The method of producing an electrostatographic color proof according to claim 1 and the step of removing said solvent from said receptor sheet by heat assisted evaporation.

* * * * *